US006467461B1

(12) United States Patent
Becker

(10) Patent No.: US 6,467,461 B1
(45) Date of Patent: Oct. 22, 2002

(54) FUEL CONTROL OF DIRECT-INJECTION INTERNAL COMBUSTION ENGINE OF A MOTOR VEHICLE, IN PARTICULAR IN START OPERATION

(75) Inventor: Ruediger Becker, Murr (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/510,456

(22) Filed: Feb. 22, 2000

(30) Foreign Application Priority Data

Feb. 26, 1999 (DE) ..... 199 08 678

(51) Int. Cl.[7] ..... F02M 37/04
(52) U.S. Cl. ..... 123/501; 123/179.17
(58) Field of Search ..... 123/446, 456, 123/447, 357, 500, 501, 179.17, 504

(56) References Cited

U.S. PATENT DOCUMENTS 5,678,521 A * 10/1997 Thompson et al. ..... 123/447
5,697,343 A * 12/1997 Isozumi et al. ..... 123/446
6,076,504 A * 6/2000 Stavnheim et al. ..... 123/447
6,085,727 A * 7/2000 Nakano ..... 123/447
6,135,090 A * 10/2000 Kawachi ..... 123/446
6,142,121 A * 11/2000 Nishimura et al. ..... 123/447

FOREIGN PATENT DOCUMENTS

DE 43 11 731 A1 10/1994

* cited by examiner

*Primary Examiner*—Carl S. Miller
(74) *Attorney, Agent, or Firm*—Michael J. Striker

(57) ABSTRACT

A method of operating an internal combustion engine of a motor vehicle supplying fuel by at least one supply pump with cyclically changing supply output into a pressure storage, injecting the fuel from the pressure storage under pressure by at least one injection valve at an injection time directly into a combustion chamber of the internal combustion engine, measuring a pressure acting on the fuel, and matching cycles of a supply output of at least one supply pump and an injection time of the fuel in time relative to one another.

7 Claims, 2 Drawing Sheets

FUEL CONTROL OF DIRECT-INJECTION INTERNAL COMBUSTION ENGINE OF A MOTOR VEHICLE, IN PARTICULAR IN START OPERATION

BACKGROUND OF THE INVENTION

The present invention relates to a method of operating an internal combustion engine, in particular of a motor vehicle.

More particularly, it relates to a method of operating an internal combustion engine, in which fuel is supplied by at least one supply pump with a cyclically varying supply output in a pressure accumulator, and injected from it under pressure by at least one injection valve at an injection time directly into a combustion chamber of the internal combustion engine, wherein the pressure acting on the fuel is measured. It is in particular switched to the phase of start operation of the internal combustion engine.

The present invention also relates to a corresponding control device, in particular for such an internal combustion engine.

The above described method is known in particular for motor vehicles with direct-injection diesel or gasoline motors. In them an injection valve is associated with each combustion chamber, with which the fuel is injected under pressure into the corresponding combustion chamber. For producing the pressure acting on the fuel, a supply pump is provided which pumps the fuel to the injection valves. Before the corresponding injection, the fuel is supplied however first to a so-called pressure storage, with which the combustion chamber or the combustion chambers of the internal combustion engine spacially communicate through one of several injection valves. The fuel pressure required for the direct injection is built up in the pressure storage by the supply pump.

With the gasoline direct injection the fuel pressure is increasingly important, since it is decisively responsible for the quality of the preparation and the penetration depth of the fuel in the combustion chamber. In particular in the so-called "shift operation" in contrast to the homogenous operation, it is necessary that the fuel at certain time and location is supplied definitely into the combustion chamber. In order to use the total potential of the pressure which is basically available during the direct-injection combustion, different pressures of the fuel during the injection in the combustion chamber are provided, depending on the operation time of combustion.

For measuring the fuel mass to be injected in the combustion chamber, the pressure which acts on the fuel during the corresponding injection is important, so for example for the same fuel mass to be injected at a high pressure, only a short injection time is required, while to the contrary with a low press re the corresponding injection valve must be controlled longer to be in its open condition.

A corresponding injection device is disclosed for example in the German patent document DE 43 11 738 A1. With this device the injection pressure measured by a pressure sensor, together with variables which are characteristic of the operational condition of the internal combustion engine, are supplied as further variables to an electronic control device for determination of the required opening time of the injection valve.

In the internal combustion engines which are known from the prior art, first an electrical pre-supply pump is provided, which produces a pressure of substantially 4 bar, depending on the motor rotary speed. The pre-supply press ure is then lifted by a main supply pump which is driven mechanically directly by the internal combustion engine to a high pressure of substantially 40–120 bar. The supply power or the supply pressure of the main supply pump is substantially dependent on the motor rotary speed and the number of the pistons of the pump.

In addition, up to now in the internal combustion engines operating in a start operation, the main supply pump is not used first for a pressure increase. Moreover, only a pre-supply pressure is built up by means of a valve, via a corresponding control of the valve for a control device. The reason for this procedure is that in the start operation, the pressure as a function of the motor rotary speed, injected fuel quantity, injection time, etc can not be adjusted in advance between the pre-supply and substantially 120 bar, and thereby the quantity of the injected fuel is not calculatable.

Furthermore, in the above mentioned direct-injection motors the injection time is very limited, since the injection can be carried out with a closed outlet valve of the combustion chamber and in a time period, in which the cylinder pressure is smaller than the pressure of the pressure storage.

In order to provide, in addition to the pressure generation, also a controlled regulation of the fuel pressure, it is further known to determine the pressure which acts in the pressure storage on the fuel by means of a pressure sensor. With the knowledge of this pressure, it is then possible by controlling an injection valve, for example by opening of the valve over a predetermined time interval, to perform the injection process in a controlled manner.

With regard to the spacial design of the pressure storage, there is a demand based on technical reasons, to increase the storage volumes. For example it is known that a temperature-dependent formation of gas bubbles in fuel in the (spacial) proximity to the injection valves can be efficiently counteracted by an increase of the pressure storage volume. In contrast, there is however a tendency, especially from cost reasons, to reduce the structural dimensions and thereby the output of the main supply pump. As a result, the time required for the pressure build up in the pressure storage during the start operation is rather increased than reduced.

The above mentioned problem becomes even worse in a main supply pump which is designed as a single cylinder pump, in that in particular with low rotary speeds which occur for example during the phase of starting of the internal combustion engine, the supply stream available from the pump is subjected to strong fluctuations in time, or in some cases to substantially periodic fluctuations.

It is further known that exactly during cold start, emissions can leave the combustion chamber almost unfiltered. In contrast to the EURO2-exhaust norms whose provisions deal with the end of a cold start, the future EURO3-and EURO4 norms also take into consideration (anticipated) the start emissions.

SUMMARY OF THE INVENTION

Accordingly, it is an object of present invention to provide a method for operating an internal combustion engine, as well as an internal combustion engine, in which the above mentioned disadvantages are eliminated.

In particular, with the inventive method and the internal combustion engine, the use of a motor-driven main supply pump with a smallest supply output is possible despite the rotary speed fluctuations occurring in the phase of the start operation and thereby the accompanied pressure fluctuations. This generally takes place in the situations, when rotary speed fluctuations or low rotary speeds lead to corresponding pressure fluctuations with regard to the supply pressure of a fuel supply pump.

In keeping with these objects and with others which will become apparent hereinafter, one feature of present invention resides, briefly stated, in a method in which the cycles of the supply output of the supply pump and the injection time of the fuel are determined in time relative to one another.

This objective in the inventive control device is achieved in that, the means for in-time determination of the cyclically changing supply output of the supply pump and injection time are provided.

The main concept of the invention is that during a fuel supply of a gasoline direct-injection internal combustion engine the supply stream as well as the pressure build up of the fuel in the pressure storage can be performed in a time range, in which in particular during a cold start, fuel is injected into the combustion chamber.

The inventive method also sets a scenario, in which the fuel pressure provided by a supply pump is varied over time, preferably in a pulsating or cyclically changing manner, so that the fuel pressure which is built up in a pressure storage or is already set is varied over time. These variations can be based for example on the supply pump which is undersupplied from the drive at low rotary speeds, since the supply pump guarantees the required supply quantity of the fuel only from a predetermined rotary speed, or in the starting phase of the operation of the internal combustion engine, when low rotary speeds of the internal combustion engine take place and moreover the maximal pressure required in the pressure storage is located in the building up phase and the buffer action of the pressure storage which makes possible a constant pressure did not come into action.

In accordance with a first embodiment, it can be provided that the aspiration/compression stroke of the supply pump is adjusted to the phase position of the internal combustion engine. It is thereby automatically guaranteed that the supply pump operates in the stroke of the internal combustion engine and thereby the injection times which strictly correlate in time with the phase length of the internal combustion engine are determined with regard to the pumping strokes.

In an alternative embodiment of the inventive method, it can be provided that the aspiration/compression stroke of the supply pump can be determined by drive cams which are suitably arranged on a cam shaft of the internal combustion engine. In this embodiment it is not required to provide a determination of the stroke control of the supply pump to the working stroke of the internal combustion engine by a control unit. Moreover, it is automatically guaranteed that the supply pump, independently from further influences is strictly determined to the machine cycle of the internal combustion engine and thereby no adjustment or tuning of the strike can be performed.

In the case of the start operation of the internal combustion engine, in particular during cold start, it can be further provided that the fuel in the region of maxima of the fuel pressure is injected into the combustion chamber. Directly during the cold start it is necessary to inject relatively great quantities of fuel into the combustion chamber, or in other words the internal combustion chamber must be supplied with at least a rich fuel mixture. Based on the injection correspondingly in the region of fuel pressure maxima it is thereby guaranteed that in each case the maximum possible fuel quantity is available during the cold start since the quantity or mass of the fuel injected in the combustion chamber otherwise is controllable only by the geometry of the injection valve opening or a change of the opening time of the injection valve.

In the inventive method it can be further provided that the value of the fuel pressure measured over a time period can be scanned, that in the region of a pressure maxima of the fuel the injection starts, that the total mass of the fuel injected at an injection time is determined by summing or integration of the product of pressure in the corresponding time interval in a corresponding time interval, and that the injection valve or valves after reaching a fuel mass suitable for the present operational condition of the internal combustion engine is or are closed. Thereby, by suitable selection of the supply time and a quantity integral over the product pressure x time in a preferable manner a relatively great fuel quantity can be introduced in the combustion chamber. In correspondence with the inventive idea exactly this pressure increase is used so that, by the calculation of the above mentioned quantity integral, the fuel is supplied in optimal quantity to the internal combustion engine.

The internal combustion engine in accordance with the present invention is provided for this solution with the corresponding means for determination of the cycles of the supply build up of the supply pump which is varied in time, to the injection times.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
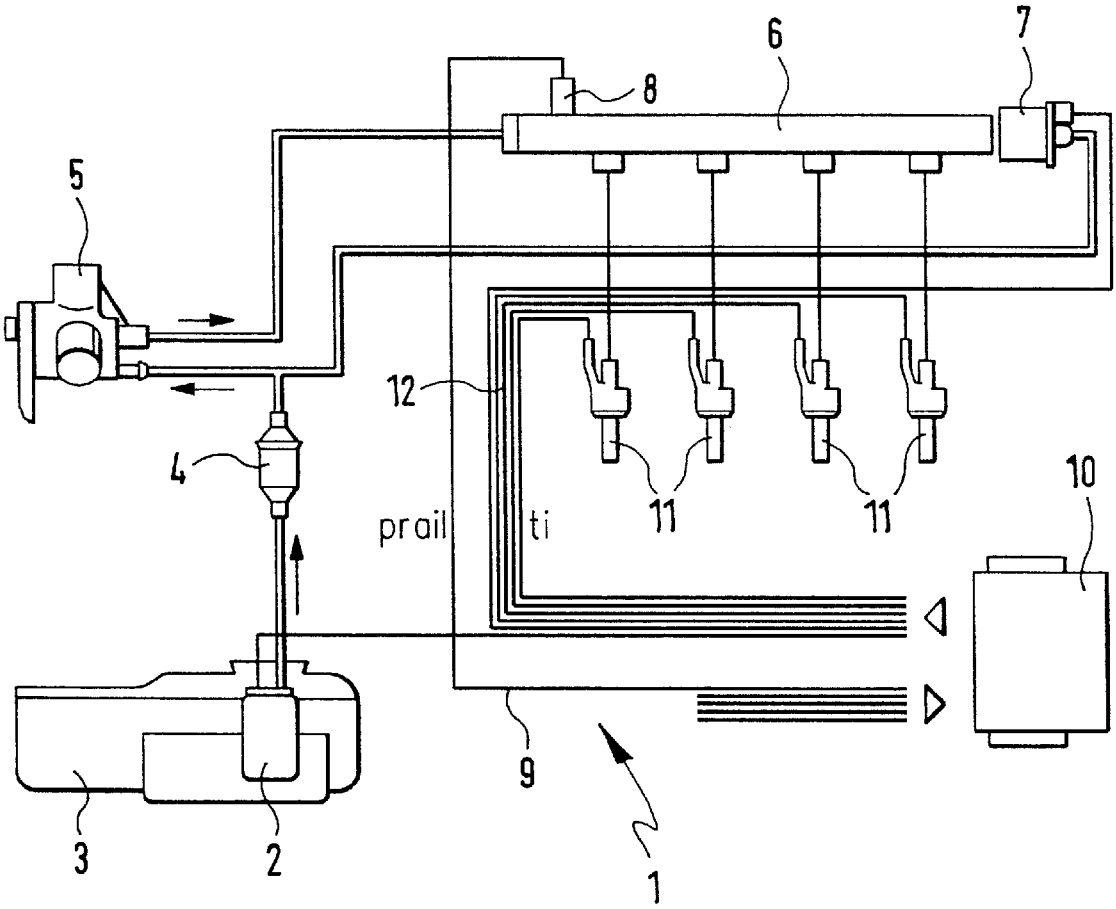
FIG. 1 is a schematic block diagram of an example of an inventive system for operating an internal combustion engine of a motor vehicle provided with several combustion chambers.

An internal combustion engine in accordance with one embodiment of the present invention is shown in FIG. 1. This figure shows a fuel supply system 1 for an internal combustion engine, which is provided for the use in a motor vehicle. The internal combustion engine has four cylinders and thereby four combustion chambers. In the internal combustion engine in accordance with the shown embodiment the fuel, preferably gasoline, is directly injected into the combustion chambers.

The fuel is transported by a pump 2 from a container 3 and through a filter 4 to a further pump 5. From the pump 5 the fuel is pumped into a pressure chamber 6. By means of the pumps 2, 5, a relatively high pressure which acts on the fuel is available in the pressure chamber 6. A pressure control valve 7 and a pressure sensor 8 are connected to the pressure chamber 6. The pressure sensor 8 can measure the pressure which is available in the pressure chamber 6 and acts on the fuel. The pressure sensor produces an electrical signal PRAIL, which corresponds to the measured pressure and which acts through a conductor 9 on an electrical control device 10. The pressure control valve 7 and the pressure sensor 8 can regulate the pressure in the pressure chamber 6, or the pressure acting on the fuel, by the control device 10 to a high and a substantially constant outlet value.

The control device 10 is formed as a programmable microprocessor which is provided with memories and corresponding required components and which is integrated in the vehicle. The control device 10 obtains the signals required for performing the method, from the corresponding sensors or from the pressure sensor A, and produce in accordance with the above described method the required signals for controlling for example the actuators, for example for controlling the injection valves 11 or the pressure control valve 7.

Four injection valves 11 are connected to the pressure chamber 6. Each of the injection valves 11 is directly associated with a combustion chamber of the internal combustion engine. With the closed injection valve 11, the pressure chamber 6 is separated from the corresponding injection chamber. The injection valves 11 are connected with the control device 10 by electrical conductors 12. For controlling one of the injection valves 11, the control device 10 produces an electrical signal ti, with which the corresponding injection valve is controlled in its open condition. The length of the signal ti corresponds to the injection time, during which the fuel is injected from the combustion chamber 6 through the corresponding injection valve 11 into the associated combustion chamber of the internal combustion engine.

Figure 2:
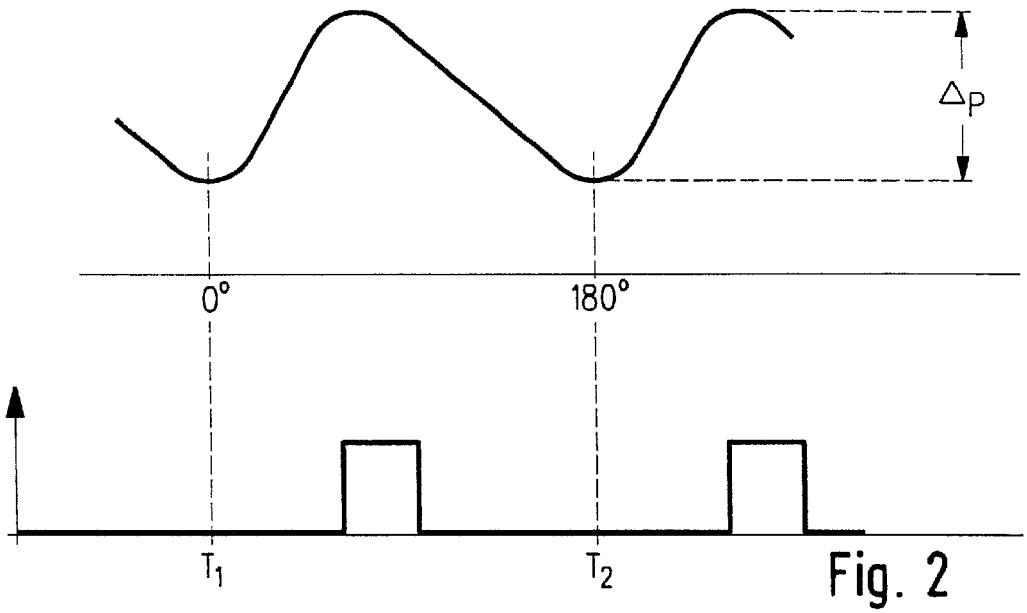
FIG. 2 is a time diagram for illustration of a method in accordance with the present invention.

The principal operation of an internal combustion chamber in accordance with the inventive method is shown in a time diagram illustrated in FIG. 2. In the lower part a typical time course of the above mentioned electrical signal ti is shown, with which a predetermined injection valve 11 is controlled in its open position. The length of signal ti corresponds thereby to the corresponding injection time. As can be seen from the diagram, each injection valve 11 receives the signal ti two times per working cycle of the internal combustion 1 (0–360°) and therefore performs two injections per one working cycle.

In the upper part of the diagram, an exemplary schematic course of the fuel pressure in the pressure storage 6 is shown. The pressure oscillates within a pressure region, or in other words cyclically varies in time. In accordance with the proposed method, the injection times are located in the region maxima of the pressure curve. Since in this example the phase lengths of the signal ti and the pressure maxima are strictly correlated in time, it is guaranteed that the shown phase length of both values ti and p is unchangeable over a long time. This fixed phase relation can be realized by a suitable time control of the supply pump 5, for example via the control device 10 or via a corresponding cam shaft control.

Figure 3A:
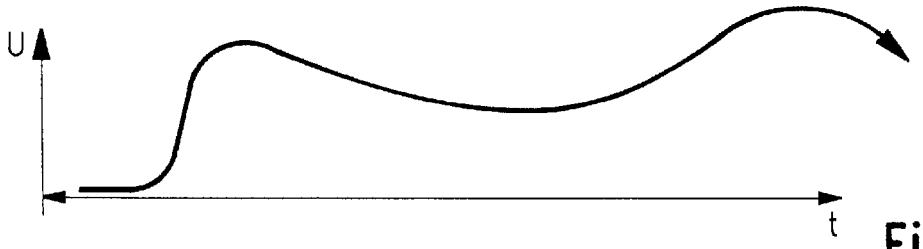
FIG. 3*a* is a view showing a rotary speed course of an inventive internal combustion engine.

The diagram shown in FIG. 3*a* illustrates a typical rotary speed course of an internal combustion engine 1 in accordance with the present invention in the start operation. In correspondence with the above mentioned working cycles of the internal combustion engine 1, the rotary speed increases in a wavy fashion or in a pulsating fashion from 0 to an idle running rotary speed (no longer shown). Within the time window shown in FIG. 3*a*, the course of the fuel pressure in the pressure storage 6, which based on the supply output of the main supply pump 5 which is correlated in time with the motor output of the internal combustion engine, resembles in its time course the rotary speed course. However, a lower phase displacement (the pressure delays relative to the rotary speed by substantially a fraction of a second) is provided because of the required running times of a pressure wave available from the main supply pump in a whole conduit system between the main supply pump 5 and the pressure storage 6. The strongest deviations between the rotary speed and the pressure, as is shown here, are located naturally at the beginning of a start of the internal combustion engine, since at this time the supply pressure in the main supply pump 5 must be first built up or stabilized.

Figure 3B:
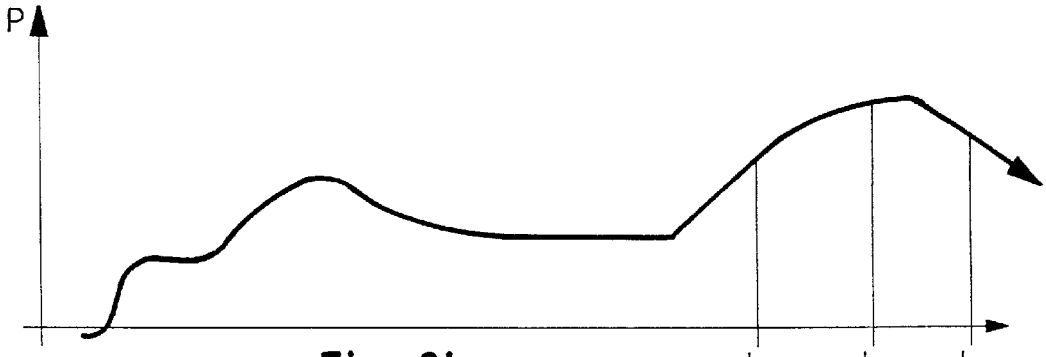
FIG. 3*b* is a view showing a corresponding pump pressure with a rotary speed of the inventive internal combustion engine shown in FIG. 3*a*.

In FIG. 3*b* it is further shown, how in correspondence with a further inventive idea the integral p*dt can be used for optimization of the fuel which is supplied as a whole during an injection. A scanning performed through a time t1 to t3 by means of a pressure tripple (t1, t2, t3) provides for a possibility of approximate finding out of a pressure maximum. When at t1 the injection of the fuel is started, the total mass of the fuel injected at this injection time can be measured by summing or integrating of the product of pressure and the time interval or in infinitesimal time interval t1 to t2 or t3, so that the corresponding injection valve 11 after reaching a fuel mass which is suitable for the present operational condition of the internal combustion engine can be again closed. Thereby, by the shown selection of the supply time and the above mentioned quantity integral, a greatest possible fuel quantity can be introduced in the combustion chambers. In correspondence with the inventive idea, this pressure increase is used exactly so as to supply fuel in an optimal way to the combustion chamber by the calculation of the above mentioned quantity integral.

It will be understood that each of the elements described above, or two or more together, may also find a useful application in other types of constructions differing from the types described above.

While the invention has been illustrated and described as embodied in fuel control of direct-injection internal combustion engine of a motor vehicle, in particular in start operation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method of operating an internal combustion engine of a motor vehicle during a start operation of the internal combustion engine, comprising the steps of supplying fuel by at least one supply pump with cyclically changing supply output into a pressure storage; injecting the fuel from the pressure storage under pressure by at least one injection valve at an injection time directly into a combustion chamber of the internal combustion engine; measuring a pressure acting on the fuel; and matching cycles of a supply output of at least one supply pump and an injection time of the fuel in time relative to one another, wherein said matching includes adjusting a suction/compression stroke of the at least one supply pump to a phase length of the internal combustion engine; and injecting the fuel in regions of maxima of a fuel pressure.

2. A method as defined in claim 1, wherein said adjusting includes adjusting the suction/compression stroke of the at least one supply pump by drive cams arranged on a cam shaft of the internal combustion engine.

3. A method as defined in claim 1, and further comprising scanning values of a fuel pressure over a time; starting with injections in a region of a pressure maximum of the fuel determining a total mass of the fuel to be sprayed at an injection time by summing or integrating a product of pressure and a corresponding smaller or infinitesimal time interval; and closing at least one injection valve after reaching a fuel mass which -is suitable for a present operational condition of the internal combustion engine.

4. A control device of an internal combustion engine of a motor vehicle for operating the internal combustion engine during a start operation, comprising a control element formed as read-only-memory in which a program is stored and a computing device formed as a microprocessor on which the program runs and which operates an internal combustion engine by a method including the steps of supplying fuel by at least one supply pump with cyclically changing supply output into a pressure, injecting the fuel from the pressure storage under pressure by at least one injection valve at an injection time directly into a combustion chamber of the internal combustion, measuring a pressure acting on the fuel, and matching cycles of a supply output of at least one supply pump and an injection time of the fuel in time relative to one another by adjusting a suction/compression stroke of said at least one supply pump to a phase length of the internal combustion engine, said injection valve injecting the fuel in regions of maxima of a fuel pressure.

5. An internal combustion engine for a motor vehicle, comprising at least one supply pump which supplies fuel with cyclically changing supply output; a pressure storage in which the fuel is supplied by said supply pump; an injection valve to which the fuel is supplied by said supply pump; an injection valve to which the fuel is supplied under pressure from said pressure storage and which injects the fuel at an injection time directly into a combustion chamber of the internal combustion engine; a pressure chamber for measuring a pressure acting on the fuel; and means for matching cycles of the cyclically changeable supply output of said at least one supply pump and the injection time by adjusting a suction/ compression stroke of said at least one supply pump to a phase length of the internal combustion engine, said injection valve injecting the fuel in regions of maxima of a fuel pressure.

6. An internal combustion engine as defined in claim 5, wherein said supply pump is formed so that it is controllable by a drive cam arranged on a cam shaft of the internal combustion engine.

7. An internal combustion engine as defined in claim 5, and further comprising a control device which scans the measured values of the fuel pressure and starts with injection in the regions of maxima of a fuel pressure, and which determines a total mass of the fuel to be injected at an injection point by summing or integrating of a product of pressure and corresponding smaller or infinitesimal time interval, said injection valve after reaching a fuel mass suitable for the operational condition of the internal combustion engine being closed off.

* * * * *